US007530323B1

(12) United States Patent
Chien

(10) Patent No.: US 7,530,323 B1
(45) Date of Patent: May 12, 2009

(54) DOUBLE-LAYER BOAT HULL STRUCTURE

(76) Inventor: Chih-Hsiung Chien, 63, Chiu Fen 3 Rd., Chyun Ying Village, Dong San, I-Lan Hsien (TW)

( * ) Notice: Subject to any disclaimer, the term of this patent is extended or adjusted under 35 U.S.C. 154(b) by 0 days.

(21) Appl. No.: 11/936,136

(22) Filed: Nov. 7, 2007

(51) Int. Cl.
*B63B 3/00* (2006.01)

(52) U.S. Cl. ..... 114/355; 114/74 A

(58) Field of Classification Search ..... 114/74 A, 114/74 R, 264, 352, 355, 356, 345, 354, 74 T
See application file for complete search history.

(56) References Cited

U.S. PATENT DOCUMENTS 2,251,621 A * 8/1941 Ven Hoorn ..... 114/355
3,704,473 A * 12/1972 Sessions ..... 114/352
4,548,154 A * 10/1985 Murata et al. ..... 114/355
5,086,723 A * 2/1992 Goldbach et al. ..... 114/74 A
5,582,124 A * 12/1996 Sikora et al. ..... 114/74 A
5,778,813 A * 7/1998 Kennedy ..... 114/74 A

* cited by examiner

*Primary Examiner*—Lars A Olson
(74) *Attorney, Agent, or Firm*—Pai Patent & Trademark Law Firm; Chao-Chang David Pai

(57) ABSTRACT

A boat hull structure includes an inner layer formed of multiple inner plates each having two mounting flanges at two sides, an outer layer formed of multiple outer plates each having two mounting flanges at two sides, multiple spacer plates connected between the mounting flanges of each two adjacent inner plates and the mounting flanges of each two adjacent outer plates to keep the inner layer and the outer layer in parallel and to define a plurality of independent air chambers between the inner layer and the outer layer, and fastening members affixing the spacer plates to the outer plates and the inner plates.

12 Claims, 8 Drawing Sheets

DOUBLE-LAYER BOAT HULL STRUCTURE

BACKGROUND OF THE INVENTION (a) Field of the Invention

The present invention relates to a boat and more particularly, to a double-layer boat hull structure for navigation on water.

(b) Description of the Prior Art

Regular boats for use as a transportation vehicle on a lake, river, or seashore area commonly have a single hull structure made of wood or composite material. Because this single hull structure is of a single-layer design, a small broken part or water leakage in the seam between two members will affect the floatability of the boat and may cause the boat to turn over and sink. Further, plastic rafts are commonly used in the inshore fishery, water fishery or culture ponds as vehicles for delivery things. A regular plastic raft is made of plastic tubes that are arranged in parallel and tied tightly together with ropes. However, this design of plastic raft is not durable in use because the ropes and the plastic tubes may break easily.

SUMMARY OF THE INVENTION

The present invention has been accomplished under the circumstances in view. It is one object of the present invention to provide a double-layer boat hull structure, which comprises an inner layer, an outer layer, and a plurality of independent air chambers defined between the inner layer and the outer layer to enhance the structural strength and floatability of the boat.

It is another object of the present invention to provide a double-layer boat hull structure, which comprises an outer layer formed of a plurality of longitudinally extending outer plates, an inner layer formed of a plurality of longitudinally extending inner plates, and a plurality of spacer plates connected between the outer plates and the inner plates to keep the outer layer and the inner layer in parallel. This double-layer design eliminates the complicated conventional main beam (keel) and sub-beam structural design, and provides a high strength.

It is still another object of the present invention to provide a double-layer boat hull structure, which is practical for constructing a high-strength impact-resistant single hull raft having an inner layer and an outer layer

DETAILED DESCRIPTION OF THE PREFERRED EMBODIMENTS

Figure 8:
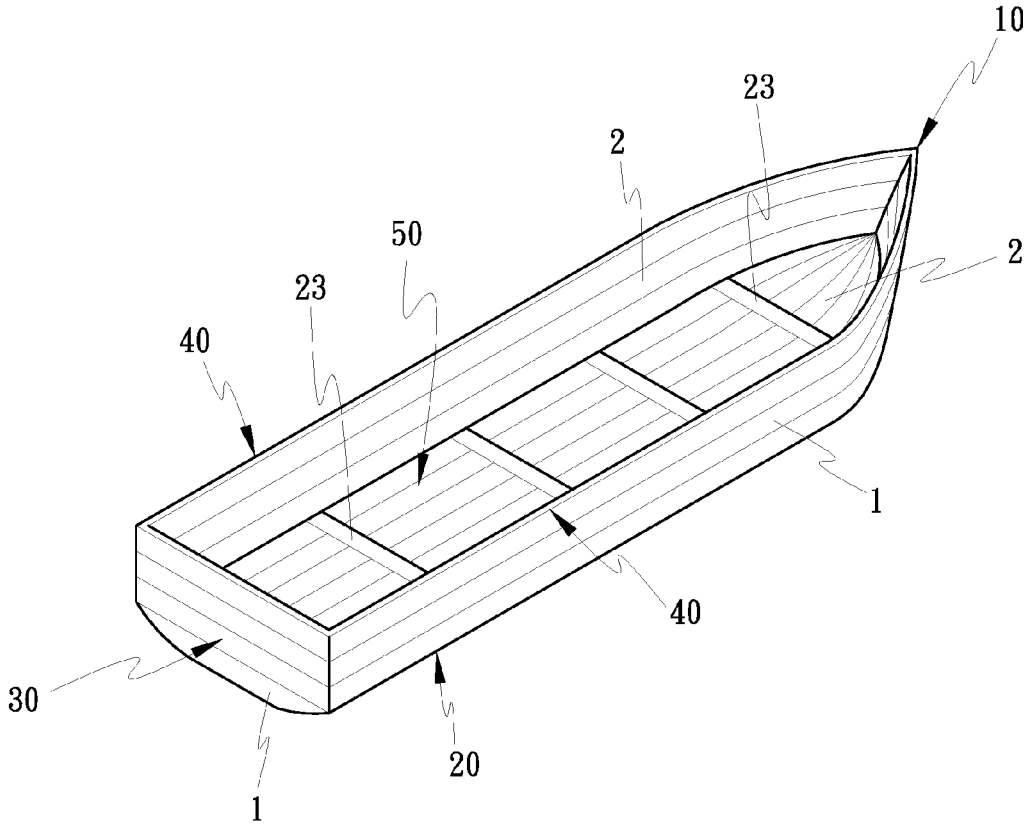
FIG. 8 is a schematic elevation of a boat hull structure with a flat bottom in accordance with the present invention.

Referring to the annexed drawings in detail, a boat hull structure in accordance with the present invention is shown comprising a bow section 10, a draft section 20, a stern section 30, and an amidships section 40, and formed of rigid outer plates 1, inner plates 2 and spacer plates 3. The bow section 10 extends archly from the center of the front side of the boat hull structure to the starboard (right side) and port (left sided) of the amidships section 40 so that the front side of the boat hull structure is sharp. The draft section 20 can be made having a double-bevel bottom side (see FIG. 1) or flat bottom side (see FIG. 8). The stern section 30 has a flat structure for the mounting of an attached power engine or motor. The amidships section 40 extends vertically upwards or obliquely upwards from two opposite lateral sides of the draft section 20. The space surrounded by draft section 20 and the amidships section 40 is the bilge 50 for carrying fishes and people.

Figure 1:
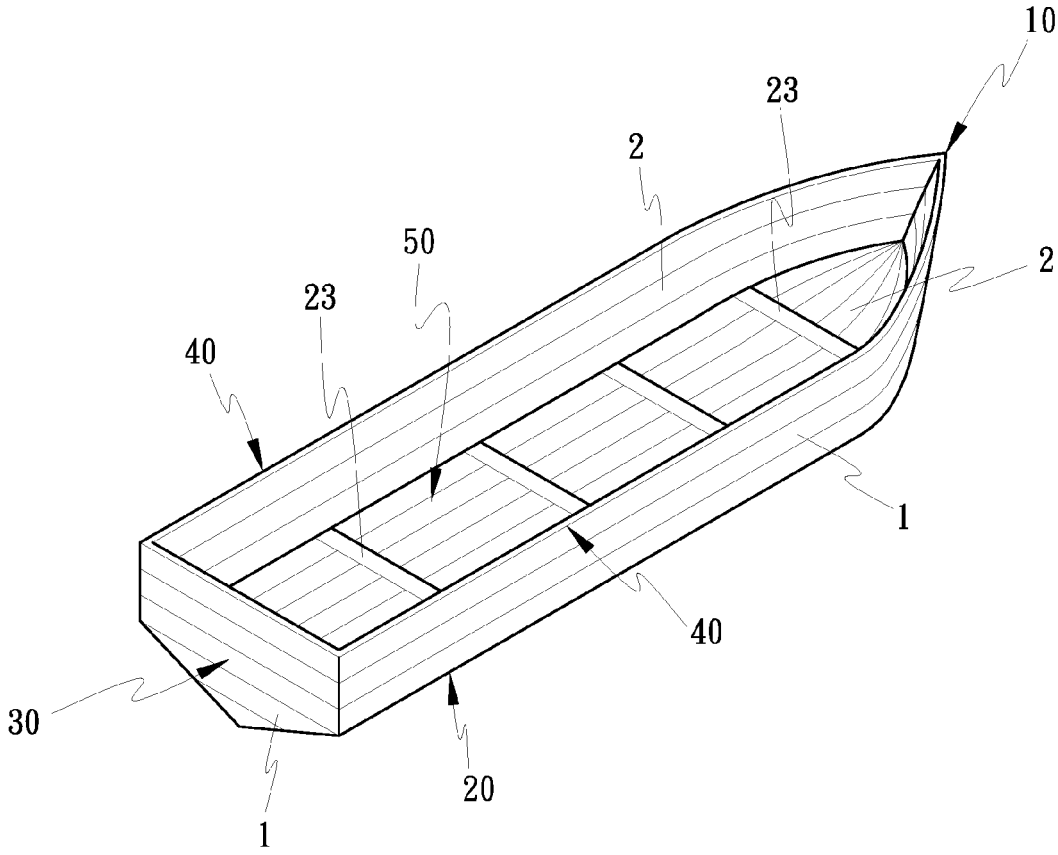
FIG. 1 is a schematic elevation of a boat hull structure with a double-bevel bottom in accordance with the present invention.
Figure 2:
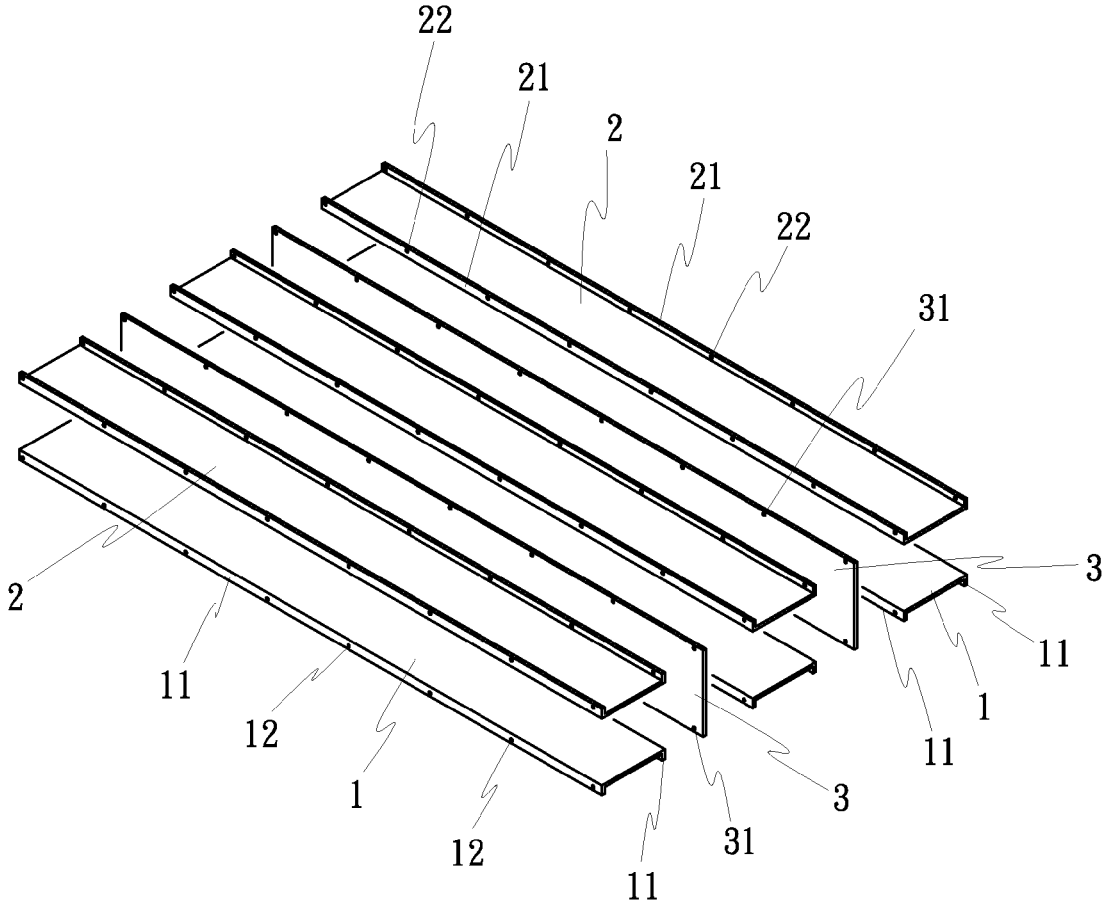
FIG. 2 is an exploded view of a part of the boat hull structure in accordance with the present invention.
Figure 3:
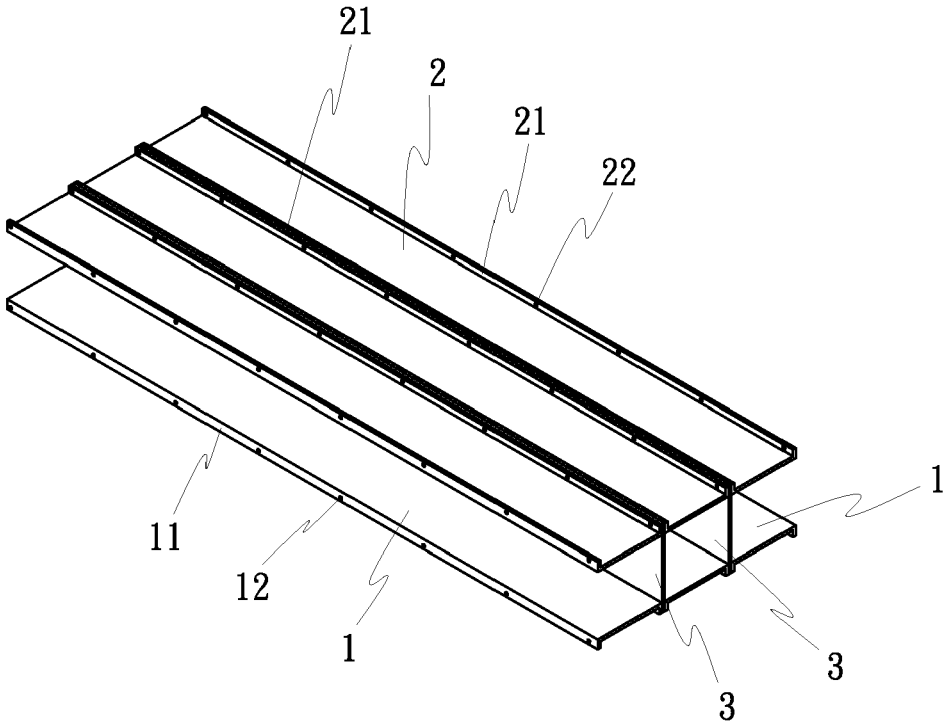
FIG. 3 is an elevational assembly view of FIG. 2.
Figure 5:
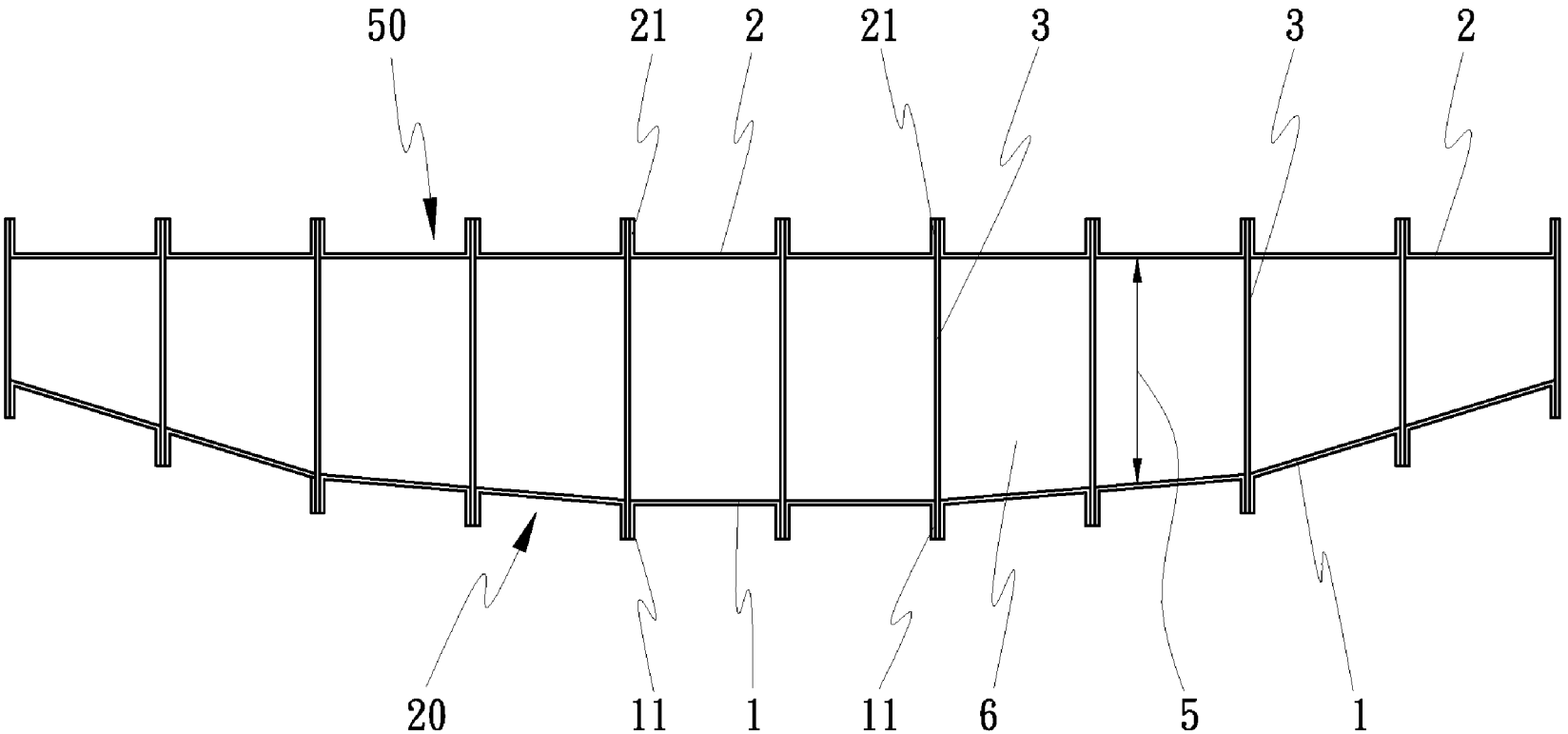
FIG. 5 is a schematic sectional view of the boat hull structure in accordance with the present invention.

The rigid outer plates 1, inner plates 2 and spacer plates 3 are fastened together, forming the bow section 10, the draft section 20, the stern section 30, the amidships section 40 and the bilge 50 (see FIGS. 1 and 5). The outer plates 1 are narrow elongated plates, each having two mounting flanges 11 respectively perpendicularly extending from two opposite sides along the length. The mounting flanges 11 each have a plurality of mounting through holes 12 equally spaced along the length for the mounting of fastening members 4. The inner plates 2 are narrow elongated plates, each having two mounting flanges 21 respectively perpendicularly extending from two opposite sides along the length. The mounting flanges 21 each have a plurality of mounting through holes 22 equally spaced along the length (see FIGS. 2 and 3) for the mounting of fastening members 4. The inner plates 2 are fastened to one another, forming the bilge 50. Further, reinforcing plates 23 are transversely affixed to the inner plates 2, reinforcing the structural strength of the bilge 50. When the outer plates 1 and the inner plates 2 are respectively fastened together, the inner plates 2 are kept spaced from the outer plates 1 at a distance 5 (see FIG. 5). The spacer plates 3 (see FIGS. 2 and 3) are narrow elongated plates, each having a plurality of mounting through holes 31 arranged in two rows along the two opposite sides. The spacer plates 3 are respectively set between each two adjacent outer plates 1 and each two adjacent inner plates 2 to have the mounting through holes 31 of each spacer plate 3 be in alignment between the mounting through holes 12 on the mounting flanges 11 of each two adjacent outer plates 1 and the mounting through holes 22 on the mounting flanges 21 of each two adjacent inner plates 1, and then fastening members 4 are respectively fastened to the mounting through holes 12, 22, 31 to affix the outer plates 1, the inner plates 2 and the spacer plates 3 together. When assembled, the spacer plates 3 keep the outer plates 1 spaced from the inner plates 2 at the aforesaid distance 5, and the outer plates 1 and the inner plates 2 define with the spacer plates 3 a plurality of air chambers 6. Therefore, the boat hull structure is a double-layer design having a high structural strength and floatable characteristics.

Figure 4:
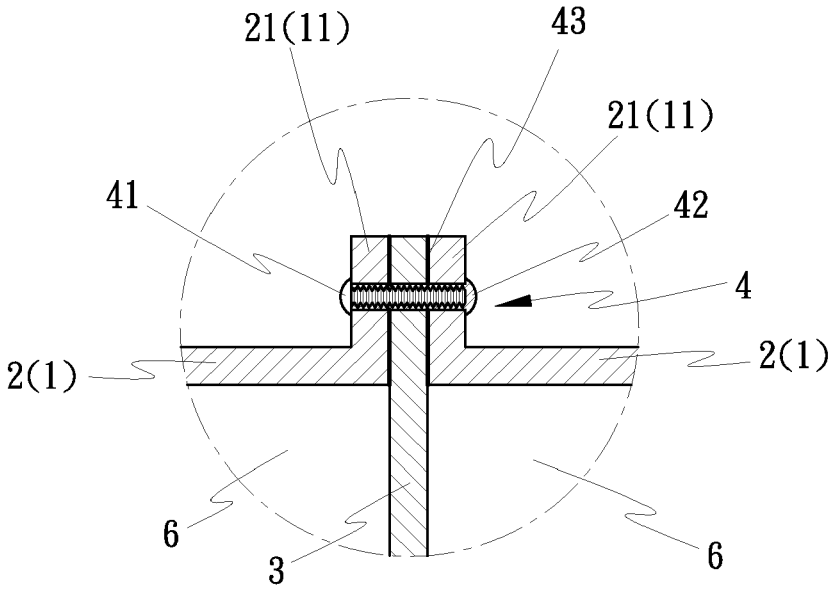
FIG. 4 is a schematic drawing in an enlarged scale of a part of FIG. 3, showing the installation of one fastening member in two inner (outer) plates and one spacer plate.

The aforesaid fastening members 4 (see FIG. 4) each are comprised of a screw 41 and a female screw 42. The female screw 42 is shaped like a hollow nail, having a screw hole 421 longitudinally extending to its one end. The female screw 42 is inserted through the respective mounting through holes 12 and 31 (22 and 31), and then the screw 41 is threaded into the screw hole 421 of the female screw 42 to affix the respective outer plates 1 and spacer plate 3 (inner plates 1 and spacer plate 3) together. Further, a sealing glue or gasket member 43 may be bonded between the outer plate 1 or inner plate 2 and the spacer plate 3 to seal the gap (see FIG. 4).

Figure 6:
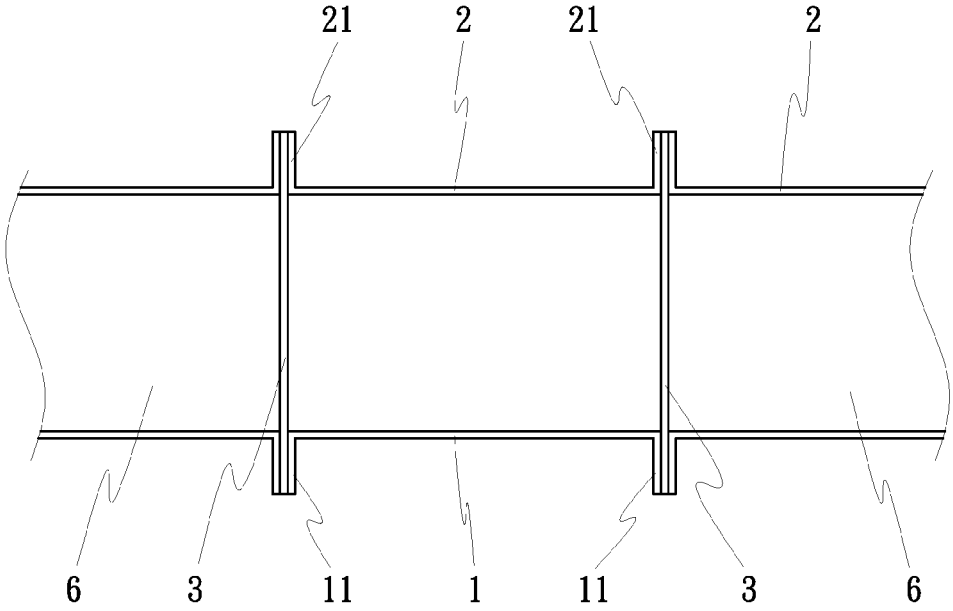
FIG. 6 is a schematic drawing showing one arrangement of the mounting flanges of the inner and outer plates.
Figure 7:
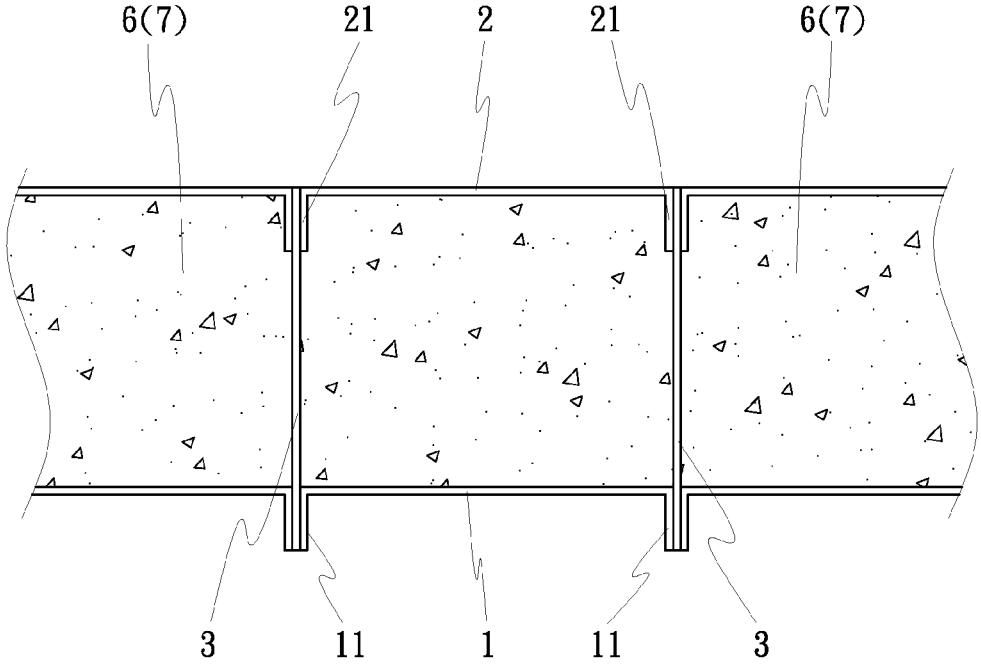
FIG. 7 is a schematic drawing showing another arrangement of the mounting flanges of the inner and outer plates.

The mounting flanges 11 of the outer plates 1 and the mounting flanges 21 of the inner plates 2 may extend outwards toward the outside of the boat hull structure (see FIG. 6). Alternatively the mounting flanges 11 of the outer plates 1 and the mounting flanges 21 of the inner plates 2 may extend inwards toward the inside of the boat hull structure, keeping the outside wall of the boat hull structure in a smooth manner (see FIG. 7). Further, the rigid outer plates 1, inner plates 2 and spacer plates 3 can be made of metal, plastics, or composite materials, such as glass fiber reinforced plastics, carbon fiber reinforced plastics, boron fiber reinforced plastics, Kevlar fiber reinforced plastics. Further, the air chambers 6 defined by the rigid outer plates 1, inner plates 2 and spacer plates 3 may be stuffed with a foam material 7 (see FIG. 7). In case one outer plate 1 or some outer plates 1 are damaged, the foam material 7 can absorb outside impact force and prohibit water from leaking into the bilge 50, assuring high security.

Figure 9:
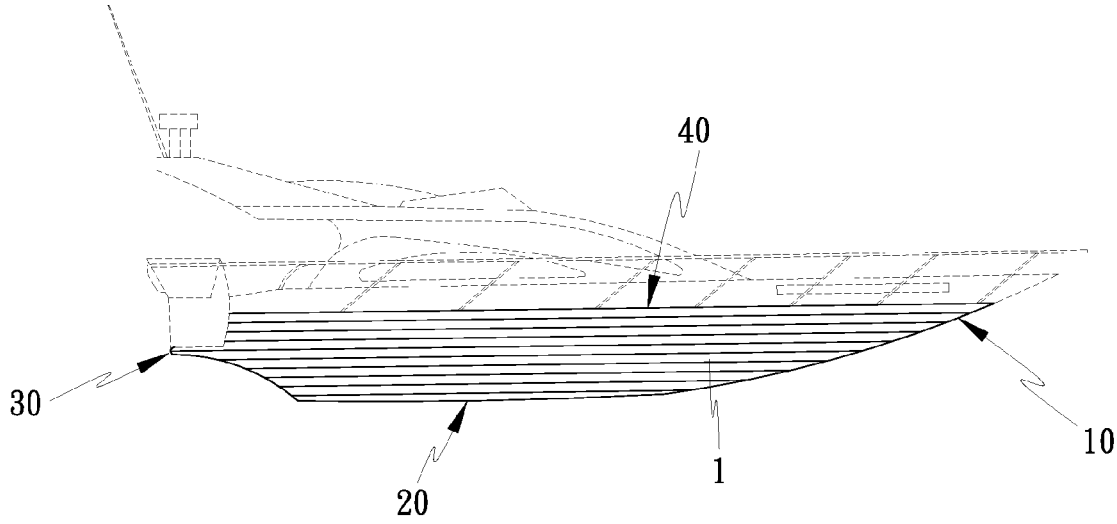
FIG. 9 is a schematic perspective view of a recreational boat embodying the present invention.

The double layer structure formed of the outer plates 1, the inner plates 2 and the spacer plates 3 have a high structural strength and multiple independent air chambers 6. Due to the effect of the independent air chambers 6, the boat hull structure has the characteristics of high floatability and high load capacity, suitable for use in fishery for delivering people or fishes. Alternatively, as shown in FIG. 9, the boat hull structure can be made in the form of a recreational boat for recreational activities. In case one outer plate 1 is damaged, the inner plates 2 can still isolate water, preventing water from leaking into the bilge 50. Therefore, the invention achieves double safety. If one outer plate 1 is damaged during the use of the boat, the other air chambers 6 are still kept intact, without affecting navigation safety. After return trip, the damaged outer plate 1 is removed from the boat hull structure, and a new outer plate 1 is installed to repair the damage. Because only the damaged outer plate 1 is replaced with a new one, the repair work is easy and needs not to replace other parts, saving much the cost.

Figure 10:
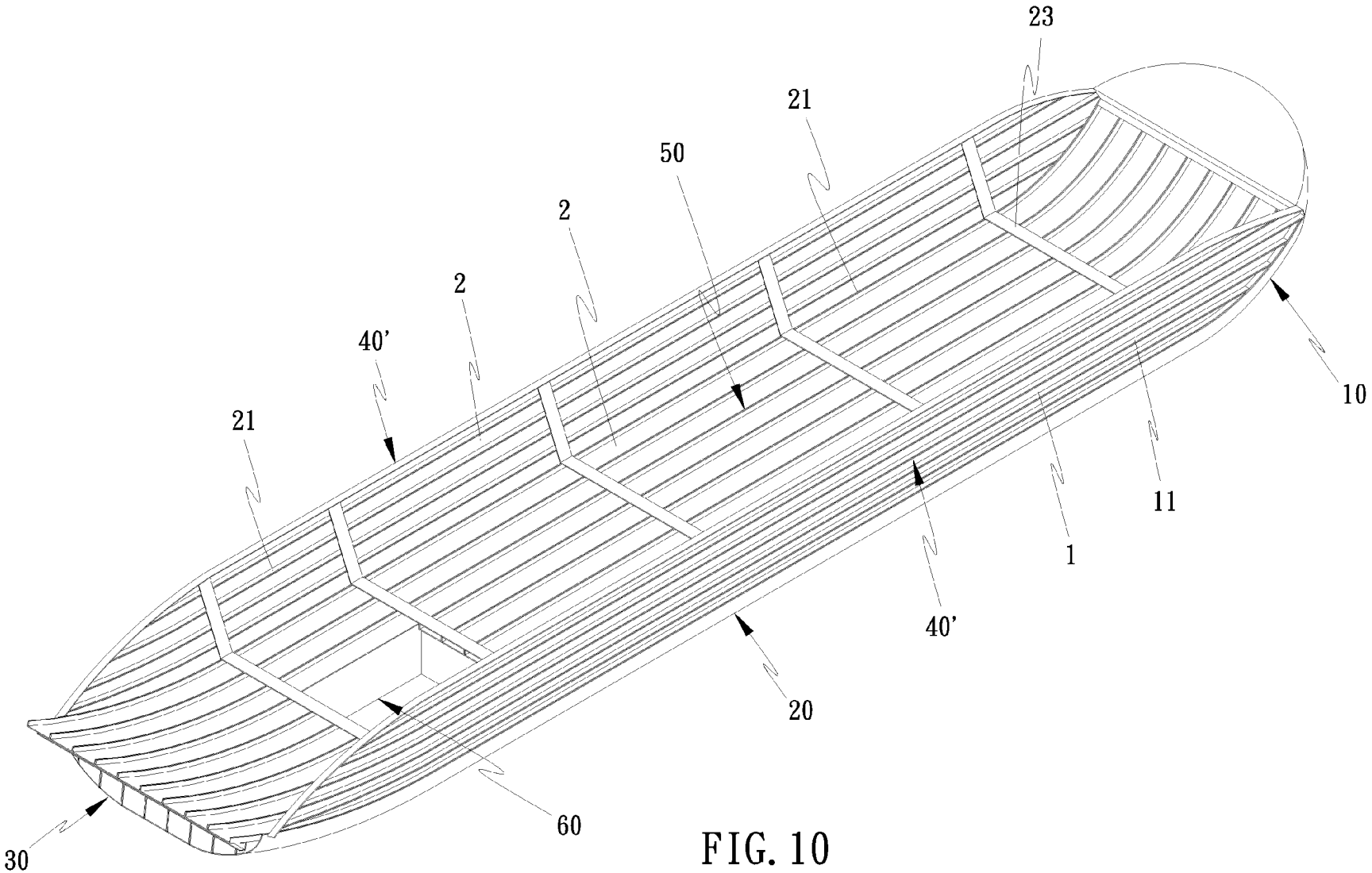
FIG. 10 is a schematic perspective view of a raft embodying the present invention.

FIG. 10 illustrates a raft constructed according to the present invention. The raft comprises a bow section 10, a draft section 20, a stern section 30, and amidships section 40'. The bow section 10 and the stern section 30 are respectively curved upwards from the front and rear sides of the draft section 20. The amidships section 40' can be formed of tubular members or rod members that are fastened together with fastening means or directly welded together. The draft section 20 and the amidships section 40' define the bilge 50. Further, the bilge 50 has an opening 60 for the mounting of an attached power engine or motor.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A double-layer boat hull structure defining a bow section, a draft section, a stern section and an amidships section, wherein said hull structure comprises an inner layer formed of a plurality of inner plates, an outer layer formed of a plurality of outer plates, a plurality of spacer plates connected between said inner plates and said outer plates to keep said inner layer and said outer layer spaced at a distance and to define a plurality of independent air chambers between said inner layer and said outer layer, and fastening members affixing said spacer plates to said outer plates and said inner plates, said outer plates each having two mounting flanges respectively perpendicularly extending from two opposite lateral sides thereof and a plurality of mounting through holes cut through the mounting flanges and arranged in line along each of the two opposite lateral sides, said inner plates each having two mounting flanges respectively perpendicularly extending from two opposite lateral sides thereof and a plurality of mounting through holes cut through the mounting flanges and arranged in line along each of the two opposite lateral sides, said spacer plates each having a first lateral side sandwiched between the mounting flanges of two adjacent outer plates, a second lateral side sandwiched between the mounting flanges of two adjacent inner plates, and a plurality of mounting through holes arranged in two lines along the first lateral side and the second lateral side and respectively connected between the mounting through holes on the mounting flanges of the associated outer plates and the mounting through holes on the mounting flanges of the associated inner plates by said fastening members.

2. The double-layer boat hull structure as claimed in claim 1, wherein said fastening members each comprise a screw, and a female screw threaded onto said screw.

3. The double-layer boat hull structure as claimed in claim 1, wherein said inner layer defines a bilge and has reinforcing plates transversely affixed to the bilge.

4. The double-layer boat hull structure as claimed in claim 1, wherein the mounting flanges of said outer plates and the mounting flanges of said inner plates respectively extend toward the outside of the hull structure.

5. The double-layer boat hull structure as claimed in claim 1, wherein the mounting flanges of said outer plates and the mounting flanges of said inner plates respectively extend toward the inside of the hull structure.

6. The double-layer boat hull structure as claimed in claim 1, wherein said outer plates, said inner plates and said spacer plates are metal plates.

7. The double-layer boat hull structure as claimed in claim 1, wherein said outer plates, said inner plates and said spacer plates are plastic plates.

8. The double-layer boat hull structure as claimed in claim 1, wherein said outer plates, said inner plates and said spacer plates are made out of a composite material.

9. The double-layer boat hull structure as claimed in claim 1, wherein the draft section of the hull structure has a flat bottom.

10. The double-layer boat as claimed in claim 1, wherein the draft section of the hull structure has a double-bevel bottom.

11. The double-layer boat hull structure as claimed in claim 1, wherein said independent air chambers are respectively stuffed with a foam material.

12. The double-layer boat hull structure as claimed in claim 1, which is a raft.

* * * * *